US005086519A

United States Patent [19]

Rokasky

[11] Patent Number: 5,086,519

[45] Date of Patent: Feb. 11, 1992

[54] INTERACTIVE LINGERIE UNDERGARMENT

[76] Inventor: Fred J. Rokasky, 316 Academy St., Carnegie, Pa. 15106

[21] Appl. No.: 651,944

[22] Filed: Feb. 7, 1991

[51] Int. Cl.[5] ..... A41B 9/04

[52] U.S. Cl. ..... 2/408; 2/406; 128/57; 128/58; 128/60; 128/61; 128/62 R; 128/63; 128/67; 128/44

[58] Field of Search ..... 2/408, 406; 128/57, 128/58, 60, 61, 62 R, 63, 67, 44, 79

[56] References Cited

U.S. PATENT DOCUMENTS

| | | | |
|---|---|---|---|
| 2,476,585 | 7/1949 | Cohen | 2/408 |
| 2,522,008 | 9/1950 | Wohlman | 2/43 |
| 2,522,009 | 9/1950 | Wohlman | 128/283 |
| 2,852,780 | 9/1958 | Gold | 2/224 |
| 3,398,739 | 8/1968 | Marino | 128/529 |
| 3,486,507 | 12/1969 | Bregenzer et al. | 128/528 |
| 3,712,308 | 1/1973 | Herbener | 2/406 |
| 3,777,764 | 12/1973 | Herbener | 2/406 |
| 3,823,721 | 7/1974 | Herbener | 2/406 |
| 4,301,550 | 11/1981 | Carver | 2/408 |
| 4,637,078 | 1/1987 | Southwell | 2/408 |
| 4,951,321 | 8/1990 | Mortensen et al. | 2/408 |

FOREIGN PATENT DOCUMENTS

| | | | |
|---|---|---|---|
| 220819 | 9/1957 | Australia | 2/408 |

*Primary Examiner*—Werner H. Schroeder
*Assistant Examiner*—Gloria Hale
*Attorney, Agent, or Firm*—Laubscher, Presta & Laubscher

[57] ABSTRACT

A interactive lingerie undergarment is characterized by projections which stimulate the genitalia during sexual intercourse. The undergarment includes a panty with an overlay flap in the crotch area which is digitally operated to provide an opening for insertion of the male sex organ. When the overlay flap is released, a snug fit around the sex organ is provided. A number of projections or nodes are provided around the opening which stimulate erogenous zones in the male and female genitalia areas to enhance sexual arousal.

7 Claims, 2 Drawing Sheets

INTERACTIVE LINGERIE UNDERGARMENT

This application is based on disclosure document Ser. No. 265442 filed Oct. 24, 1990.

BACKGROUND OF THE INVENTION

During human love making and prior to actual copulation, humans practice certain behavioral mannerisms or foreplay to heighten sexual arousal. One such mannerism is for females to wear lingerie. Most men and women consider the wearing of intimate apparel as very sensual, feminine and beautiful. The texture of lingerie fabric extends from gossamer sheer, to silky softness, to a standard type cotton material. This texture can also heighten passion between the lovers.

In the art of love making all five human senses are at work. The one sense that is most prevalent is the sense of touch. The wearing of lingerie by a woman while with her mate is exciting and stimulating to both individuals as the feel of the lingerie is transmitted to the pleasure area of the brain. Before intercourse, it is necessary to interrupt the foreplay, if only briefly, to remove certain parts of a lingerie ensemble; i.e. the panties or underwear. This interruption is annoying to the sexual partners.

BRIEF DESCRIPTION OF THE PRIOR ART

It is known in the prior art to provide women's panties with overlapping layers of fabric which can be manipulated to provide an opening. The U.S. Pat. No. 4,301,550, to Carver, for example, discloses a pantyhose garment constructed with overlapping flaps which can be separated to define an opening through which urination may be accomplished without removal of the garment.

While the prior undergarments operate satisfactorily, they were not designed for wearing during intercourse, and thus provide little in the way of sexual arousal when so used. The present invention was developed in order to provide lingerie apparel containing an aperture for love making while the apparel is being worn and to provide erotic stimulation of the genitalia during intercourse.

SUMMARY OF THE INVENTION

Accordingly, it is a primary object of the present invention to provide a female lingerie undergarment for enhancing sexual arousal including a panty containing leg openings surrounded by bands of elastic and an overlap flap connected with front and rear portions of the pantry with side edges having elastic bands arranged adjacent to the leg openings of the panty. Sexual stimulators in the form of projections are connected with the panty and with the flap in the crotch area adjacent the leg openings, respectively. Thus, a crotch opening is defined when the panty and flap edges having the projections connected therewith are pulled toward the opposite leg openings. When a penis is inserted into the opening and the edges are released, the elastic bands of the panty and flap bias the projections toward the male and female genitalia to enhance sexual arousal.

The projections may comprise rigid or resilient rounded bodies or beads which are sewn into pockets in the panty and flap. Alternatively, the projections may be formed on the surface of a piece of fabric which is sewn onto the panty and flap.

According to a further objection of the invention, additional stimulating projections are provided in the abdominal area of the panty.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
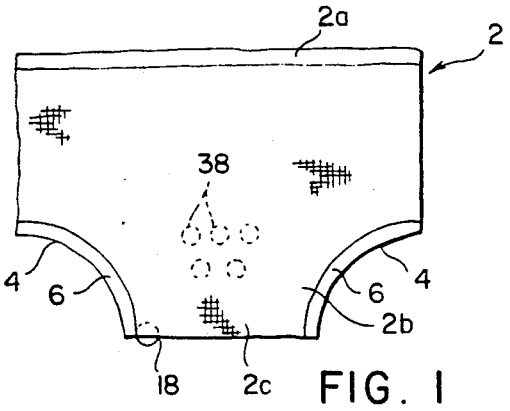
FIGS. 1 and 2 are front and bottom plan views, respectively, of the panty according to the invention.
Figure 2:
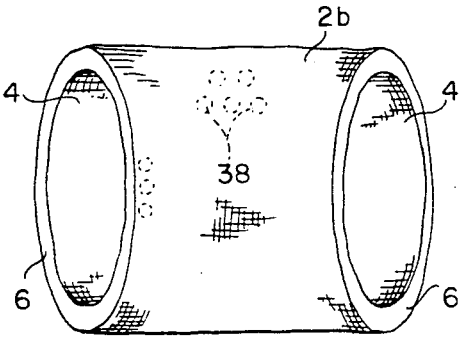

Referring first to FIGS. 1 and 2, the panty portion of the interactive lingerie undergarment for enhancing sexual arousal will be described. The panty 2 includes a waist portion 2*a*, an abdominal portion 2*b*, and a crotch area 2*c*. On either side of the abdominal portion are leg openings 4. Within the edges of the panty surrounding each leg opening are provided bands of elastic 6.

Figure 5:
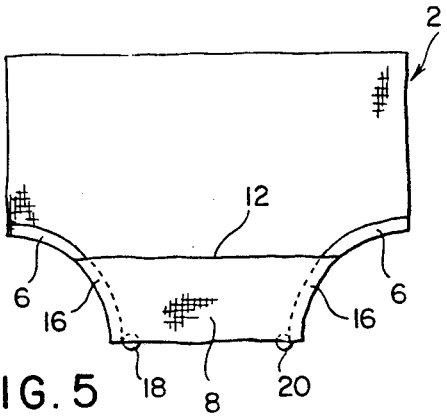
FIGS. 5 and 6 are front and bottom plan views, respectively, of the assembled flap and panty which comprise the interactive lingerie of the invention.
Figure 6:
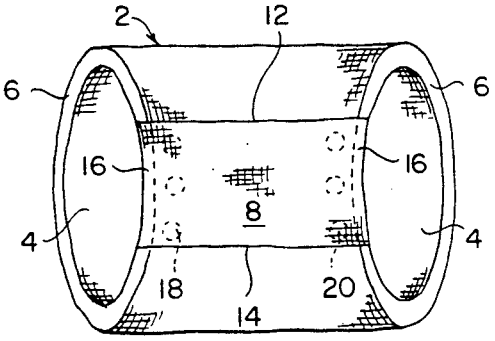
Figure 3:
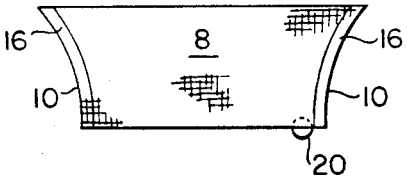
FIGS. 3 and 4 are front and bottom plan views, respectively, of the panty overlay flap according to the invention.

As shown in FIGS. 3–6, an overlay flap 8 is connected with front and rear portions of the panty 2. The flap 8 has side edges 10 arranged adjacent the leg openings 4 in the panty and is stitched to the panty along front 12 and rear 14 horizontal lines so that the flap overlays the crotch area 2*c* of the panty. The side edges of the overlay flap are provided with bands of elastic 16 which as shown in FIGS. 5 and 6 are colinear with the elastic bands 6 of the panty.

The panty 2 and overlay flap 8 are provided with nodes or projections 18, 20 which with the bands of elastic 6, 16 provide sexual stimulation during intercourse as will be set forth in greater detail below.

As shown in the drawing, the projections 18 are connected with the panty 2 in the crotch area 2*c* thereof adjacent to only one of the leg openings 4. In the drawing, the projections are provided in an edge 19 adjacent to the right leg opening. The projections 20 connected with the flap 8 are arranged in the crotch area in an edge 21 adjacent to the other (i.e. left) leg opening. Of course, the panty projections 18 may be provided adjacent the left leg opening with the flap projections 20 adjacent to the right leg opening if desired. It is only necessary that the projections of the panty and flap be provided adjacent opposite leg openings, respectively.

Figure 7:
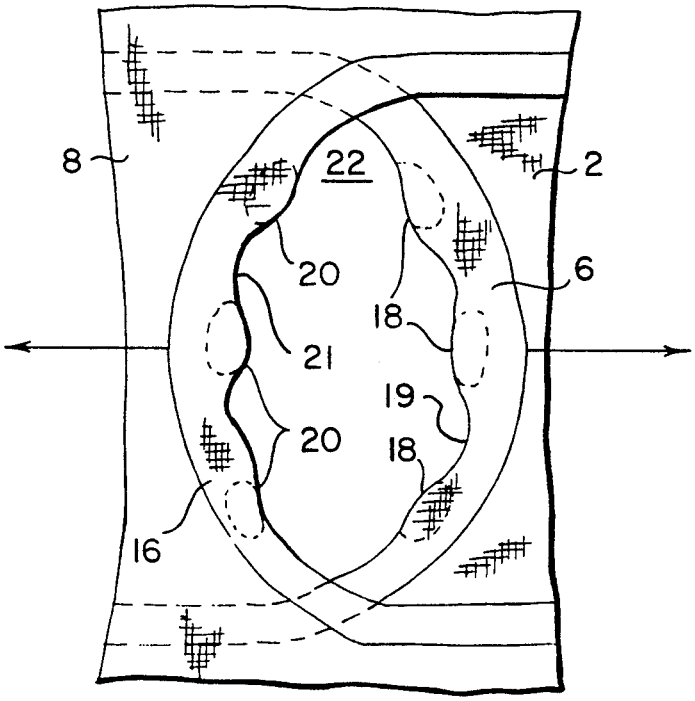
FIG. 7 is a bottom view of the crotch area of the lingerie garment of FIG. 6 in the open position.

Referring now to FIG. 7, an opening 22 in the crotch area of the lingerie garment is created by digitally manipulating the edges of the flap 8 and panty 2 along which the projections are provided. More particularly, the projection containing edges 19, 21 are pulled in the direction of the opposite leg opening as shown by the arrows in FIG. 7.

The opening affords access of the male sex organ during intercourse without requiring removal of the lingerie undergarment. Thus a smooth transition from sexual foreplay to copulation without interruption for removal of the undergarment is provided. Following insertion of the penis through the opening 22, the edges of the panty and flap which had been pulled apart to define the opening are released. The elastic bands 6, 16 in the panty and flap bias the projections against the penis and also hold tight the general female genitalia area causing greater contact therewith. During intercourse, the projections stimulate erogenous zones in the male and female genitalia areas to enhance sexual arousal during lovemaking.

Figure 8:
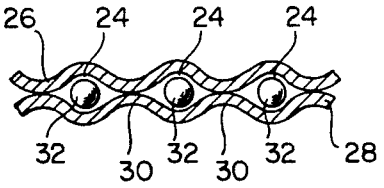
FIG. 8 is a sectional view of the stimulating projection beads according to a first embodiment of the invention.
Figure 4:
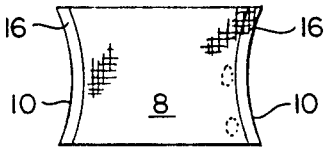

The projections 18, 20 may be connected with the panty and flap in one of two ways. According to a first embodiment shown in FIG. 8, pockets 24 are defined in the edges of the panty and flap by stitching a cover layer of fabric 26 (i.e. satin, lace, cotton, etc.) to a base layer 28 (i.e. the panty or flap) at spaced intervals 30. Arranged within the pockets are rounded or oval beads 32 which define the projections or nodes. The beads can be formed of a rigid material such a stainless steel, gold, silver, opals, pearls or diamonds or a resilient material such as soft latex material. Wet ice may also be placed in the pockets to define the projections. The pockets may have closures (not shown) which may be opened to substitute different types of beads in the pockets if desired.

Figure 9:
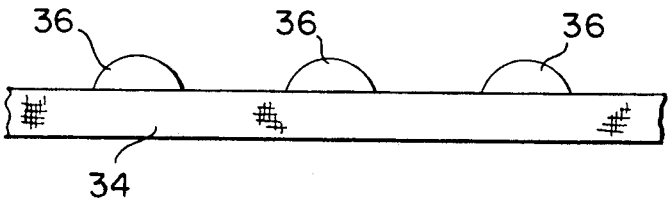
FIGS. 9 and 10 are side and top plan views, respectively, of a layer of fabric having projections thereon according to a second embodiment of the invention.
Figure 10:
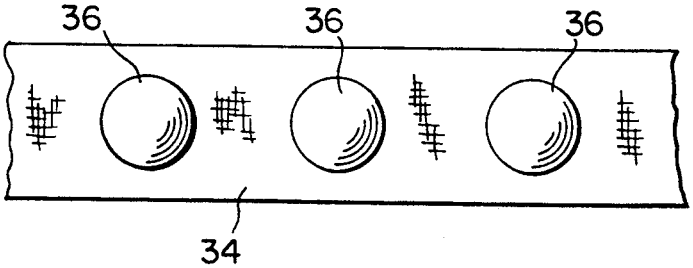

An alternate construction of the projections will be described with reference to FIGS. 9 and 10. In this embodiment, a piece of fabric 34 has bumps 36 formed on a surface thereof. The fabric 34 is then stitched to the panty and flap adjacent the appropriate edge thereof. The fabric may comprise a braided loop, lace, or knotting. Alternatively, a heavier gauge of thread may be sewn into the edge of the panty and panel to a thickness of not less than an eighth of an inch, whereby the stitching comprises the projections. Silk thread or the like is recommended for the stitching. Other alternatives are to line the panty and panel edges with fringe or tassels. It will be appreciated by those skilled in the art that a wide variety of materials may be connected with the panty and flap edges to provide the projections or nodes which afford sexual stimulation.

For further sexual arousal, a plurality of projections 38 are arranged in the abdominal area **2*b* of the panty as shown in FIGS. 1 and 2. The projections 38 can be of the type of either FIG. 8 or FIGS. 9 and 10** described above.

While in accordance with the provisions of the patent statute the preferred forms and embodiments of the invention have been illustrated and described, it will be apparent to those skilled in the art that various changes and modifications may be made without deviating from the inventive concepts set forth above.

What is claimed is:

1. A female lingerie undergarment for enhancing sexual arousal, comprising (a) a panty containing leg openings and including an elastic band surrounding each leg opening;

(b) an overlay flap connected with front and rear portions of said panty and having side edges arranged adjacent to said panty leg openings, said flap including elastic bands connected with said side edges; and (c) stimulation means connected with said panty in a crotch area adjacent one of said leg openings and with said flap side edge in a crotch area adjacent the other of said leg openings, whereby a crotch opening is defined by pulling said panty and said flap edges having said stimulation means connected therewith toward the opposite leg openings, respectively, and further whereby when a penis is inserted into said opening and said edges are released, said elastic bands of said panty and said flap bias said stimulation means toward the male and female genitalia to enhance sexual arousal.

2. An undergarment as defined in claim 1, wherein said stimulation means are sewn into said panty and flap edges.

3. An undergarment as defined in claim 2, wherein said stimulation means comprise a layer of fabric having a surface containing a plurality of projections.

4. An undergarment as defined in claim 1, wherein said panty and said flap contain a plurality of pockets for receiving said stimulation means.

5. An undergarment as defined in claim 4, wherein said stimulation means comprise a plurality of rigid rounded members arranged in said plurality of pockets, respectively, thereby to define a plurality of nodes.

6. An undergarment as defined in claim 4, wherein said stimulation means comprise a plurality of resilient rounded members arranged in said plurality of pockets, respectively, thereby to define a plurality of nodes.

7. An undergarment as defined in claim 1, wherein said stimulation means are further connected with said panty in an abdominal area.

* * * * *